US006492632B1

(12) United States Patent
Pollin

(10) Patent No.: US 6,492,632 B1
(45) **Date of Patent: *Dec. 10, 2002**

(54) LOCK AND SLIDE MECHANISM FOR TUBE LAUNCHED PROJECTILES

(76) Inventor: Irvin Pollin, 6600 Michaels Dr., Bethesda, MD (US) 20817

( * ) Notice: Subject to any disclaimer, the term of this patent is extended or adjusted under 35 U.S.C. 154(b) by 32 days.

This patent is subject to a terminal disclaimer.

(21) Appl. No.: 09/663,251

(22) Filed: Sep. 15, 2000

Related U.S. Application Data

(63) Continuation-in-part of application No. PCT/US99/00399, filed on Jan. 28, 1999.
(60) Provisional application No. 60/154,369, filed on Sep. 17, 1999.

(51) Int. Cl.[7] ..... F42B 10/00
(52) U.S. Cl. ..... 244/3.3; 244/3.24; 102/439; 102/517
(58) Field of Search ..... 244/3.1, 3.24, 244/3.26, 3.3; 102/376, 434, 439, 473, 490, 501, 517, 518, 372, 373

(56) References Cited

U.S. PATENT DOCUMENTS

| | | | | |
|---|---|---|---|---|
| 46,490 A | | 2/1865 | Orwig | 244/3.3 |
| 656,933 A | | 8/1900 | Brown | 244/3.3 |
| 656,934 A | | 8/1900 | Brown | 244/3.3 |
| 1,049,144 A | * | 12/1912 | Quisling | 244/3.26 |
| 1,278,786 A | | 9/1918 | Teleszky | 244/3.3 |
| 1,417,460 A | | 5/1922 | Driggs, Jr. | 102/439 |
| 2,437,211 A | | 3/1948 | Schermuly et al. | 244/3.26 |
| 3,007,410 A | | 11/1961 | Blacker | 244/3.3 |
| 3,086,467 A | | 4/1963 | Gallagher et al. | 244/3.26 |
| 3,125,957 A | | 3/1964 | Lipinski | 244/3.26 |
| 3,292,879 A | | 12/1966 | Chilowsky | 244/3.3 |
| 3,677,179 A | | 7/1972 | Potteiger et al. | 102/473 |
| 4,489,949 A | | 12/1984 | Taylor et al. | 244/3.3 |
| 4,541,342 A | | 9/1985 | Routledge | 102/309 |
| 4,572,463 A | | 2/1986 | Ashkenazi | 244/3.3 |
| 4,624,187 A | | 11/1986 | Bocker et al. | 102/517 |
| 4,674,706 A | | 6/1987 | Hall | 244/33 |
| 4,964,341 A | | 10/1990 | Hebert | 102/473 |
| 5,892,217 A | | 4/1999 | Pollin | 244/33 |

FOREIGN PATENT DOCUMENTS

| | | | |
|---|---|---|---|
| DE | 39 04 625 A1 | 8/1990 | 102/518 |
| FR | 2 535 450 | 5/1984 | 102/518 |
| GB | 2 257 238 A | 1/1993 | 102/517 |

OTHER PUBLICATIONS

Translation of French Patent 2,535,450.*

* cited by examiner

*Primary Examiner*—Harold J. Tudor

(57) ABSTRACT

A tube launched projectile having a shaft member at the aft section is slidably mounted on a boom extending aft from the body of the projectile. The boom has a cavity in its aft end which receives some combustion gas from the projectile propellant burn and retains this gas at elevated pressure until the projectile exits the tube. Upon reaching atmospheric pressure, the stored cavity gas expands and drives the slidable shaft aft, elongating the projectile to its flight configuration.

22 Claims, 5 Drawing Sheets

LOCK AND SLIDE MECHANISM FOR TUBE LAUNCHED PROJECTILES

CROSS REFERENCE TO RELATED PATENT

This application claims priority from my U.S. Provisional Patent Application Ser. No. 60/154,369, entitled "Lock And Slide Mechanism For Tube Launched Projectiles", filed Sep. 17, 1999. This application is also a Continuation-In-Part application of my co-pending PCT application Ser. No. PCT/US99/00399, entitled "Lock And Slide Mechanism For tube Launched Projectiles", filed Jan. 28, 1999, which is based on my prior U.S. patent application Ser. No. 08/985,292, filed Dec. 4, 1997, now U.S. Pat. No. 5,892,217, issued Apr. 6, 1999. The disclosures in all of those applications are hereby incorporated herein by reference.

BACKGROUND OF THE INVENTION

This invention relates in general to tube launched projectiles and in particular to tube launched projectiles which are fin stabilized or spin stabilized, where means are provided to elongate the projectile body when the projectile exits the launch tube.

Reduced length projectiles allow for reduced cost of transport and for increased launch tube propellant charge. In the case of fin stabilized projectiles the center of pressure of the fins can be relatively close to the projectile center of gravity. This configuration requires the fins be larger than for an elongated projectile to provide a restoring moment for control of the flight of the projectile. Since projectile fins typically contribute 30% to 50% of the total projectile aerodynamic drag, reductions in projectile drag would be desirable.

SUMMARY OF THE INVENTION

The present invention overcomes the disadvantages of fixed length projectiles detailed above by mounting the empennage or tail section on a hollow shaft which surrounds a portion of the projectile boom extending from the projectile body. The shaft is caused to slide along the boom in a constrained manner. The shaft is provided with axially extending splines spaced around its circumference which are assembled into matching grooves extending along the length of the boom. Thus, the projectile is assembled initially with the shaft in the most forward position. Means are provided for retaining the shaft in the forward position until the projectile exits the launch tube. The shaft is caused to slide to a rear, in-flight position after exiting the launch tube and is locked in the flight position during flight. The mechanism for extending the projectile to its flight length configuration utilizes the high pressure gas from the burning propellant to initially lock the shaft and boom in the pre-flight position during transit in the tube and to cause the shaft to slide to the flight position after exiting the launch tube. As an alternate or additional embodiment, a separate solid propellant or compressed gas cylinder may be provided in the projectile boom to cause the shaft to slide to the flight position.

A 10% to 25% reduction of projectile aerodynamic drag can be realized by the present invention whereby the projectile body elongates when the projectile has cleared the launching tube. This elongation occurs by causing the empennage containing the fin structure to slide rearward to a new flight position, effectively moving the fins rearward and achieving the advantages discussed above. Similarly, the rearward movement of the tail section and the accompanying shape change allows for significant changes in the stability characteristics and reduction of aerodynamic drag of spin-stabilized projectiles.

This invention is applicable forfin-and spin-stabilized tube launched projectiles. The empennage comprised of fins (fin-stabilized) or the aft body without fins (spin-stabilized) is mounted on a hollow shaft and at atmospheric ambient pressure is free to slide on a matching boom attached to the aft end of the projectile. At atmospheric ambient pressure, a small clearance between shaft and boom, say 0.001 inch, allows the shaft to move freely relative to the boom. Rotation between the shaft and boom is prevented by the following construction: axially extending slots or grooves provided in the boom, along with axially extending splines provided in the forward end of the shaft allow for the axial sliding of the shaft relative to the boom without rotation.

In my aforementioned patent 1 describe the shaft as deflecting onto the boom such that the two surfaces mechanically "lock" onto one another at the high tube pressures accompanying propellant ignition, whereupon the shaft moves with the boom inside the tube. I describe this "locking" as being attained on deflection by providing each surface with intermeshing ridges running orthogonal to the projectile axis, and/or by matching engaging teeth, and/or the like, and/or by providing a high friction coefficient between the two surfaces. Thus, at the high tube pressures, the mechanical "lock" is comprised of either of one or of a combination of intermeshing surfaces and friction shear stresses between the inner shaft and outer boom surfaces. Hence, following ignition of the projectile propellant, except possibly for an initial small insignificant movement until the tube pressure becomes sufficiently large, the shaft is "locked" onto and moves with the boom during the projectile transit in the tube.

I have now discovered an alternative means for locking the shaft onto the boom by using the axial or longitudinal force resulting from the differential pressure between the external and internal surfaces of the shaft vertical end wall (i.e., the aft end wall) created by the elevated tube pressure. This differential pressure acting on the shaft vertical end wall causes the shaft to travel with the boom during the shaft's transit in the tube. The "locking" and conjoined travel ceases upon exposure of the shaft to the reduced ambient atmospheric pressure as the projectile egresses from the tube. In order for this type of "locking" to occur, the ratio of the axial acceleration of the shaft to the axial acceleration of the main body projectile must be equal to or greater than one. Stated mathematically:

$$a_S/a_P=(p_S/p_P)(A_S/A_P)(m_P/m_S)\geqq 1,$$

where: "a" represents axial acceleration; "p" represents differential pressure; "A" represents area normal to the launch tube centerline; "m" represents mass; and the subscripts "S" and "P" represent the shaft and main body projectile, respectively. $A_S$ does not include the area of the orifice opening 22 and any other open area not developing the differential pressure $p_S$. This formula applies for materials of any friction coefficient and dictates the accelerations required to "lock" the boom and shaft during transit in the launch tube. Inherent in the formula is the launch tube pressure (p) developed after the propellant charge is ignited in the launch tube, and which is approximately equal to ps and pp.

This method of axial "locking" effected by the differential pressure on the shaft vertical end wall can be utilized by itself or in conjunction with the mechanical locking described in my aforementioned patent.

An orifice at the base of the shaft serves as the opening to a small cavity within the boom. Propellant gases enter the cavity and the cavity pressure rises as a consequence of the high tube pressures during the transit of the projectile in the tube. Upon the projectile exiting the tube and the accompanying reduction of ambient pressure, the differential pressure across the shaft vertical end wall drops so that the force on the end wall of the shaft is removed, causing the shaft to "unlock" and again be free to move relative to the boom. Furthermore, the high pressure of the gas trapped in the cavity relative to that of the ambient atmosphere acts on the vertical end wall of the shaft producing a rearward movement of the shaft relative to the boom and thereby a lengthening of the projectile. The shaft slides along the boom and the projectile continues to lengthen until the splines in the shaft reach a taper lock in the boom, where it becomes jammed and locked into place on the boom. The time required for the shaft deployment depends in part on the cavity volume, orifice diameter, and deployment length. The shaft deployment and thereby the projectile length can be increased by several calibers within a short distance of the tube exit.

DETAILED DESCRIPTION OF THE PREFERRED EMBODIMENT

Figure 1:
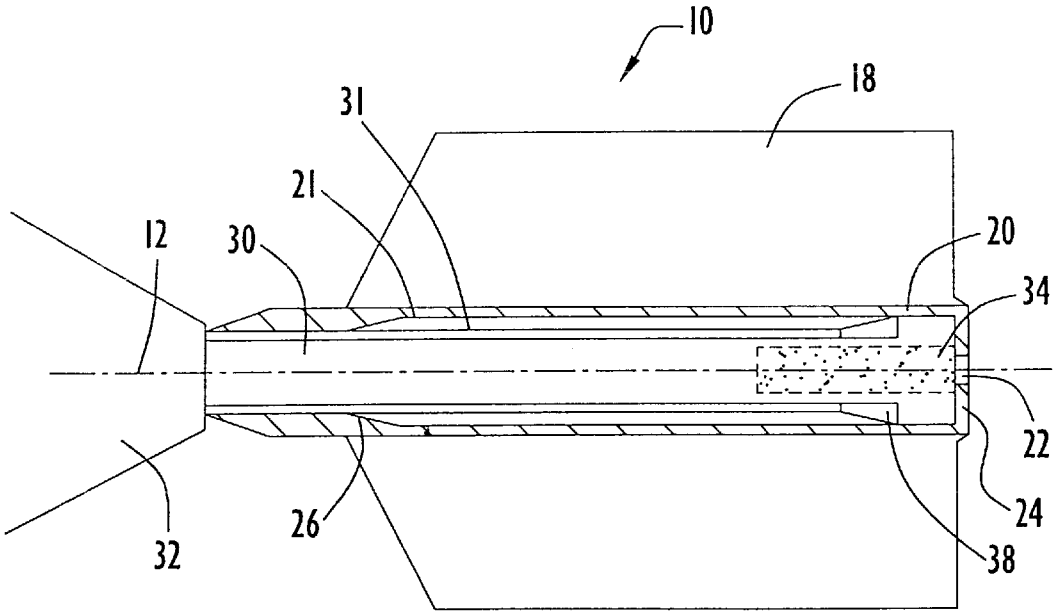
FIG. 1 is a partial longitudinal sectional view of the projectile in the pre-launch condition.

Referring now to FIG. 1, the projectile is shown generally at 10. For a fin-stabilized projectile, FIG. 1 illustrates an empennage 18 mounted on a slidable hollow shaft 20 and a fixed boom 30 extending from a projectile body 32 as it would appear in the launch tube under atmospheric pressure, prior to propellant ignition and prior to elongation. The projectile body 32 has a payload at its fore end (not shown). The projectile body 32 also defines a longitudinal axis 12. FIG. 1 also shows the intermeshing ridges, engaging teeth, and/or the like, and/or friction "locking" surfaces 21 and 31 of the shaft 20 and boom 30, respectively, a cavity 34 at the end of the boom 30, and an orifice 22 in a vertical end wall 24 of the shaft 20. As described in my prior patent, surfaces 21 and 31 may be forced into locking engagement by the differential pressure between the outside surface and inside surface 21 of shaft 20 created by propellant combustion as described below.

Figure 2:
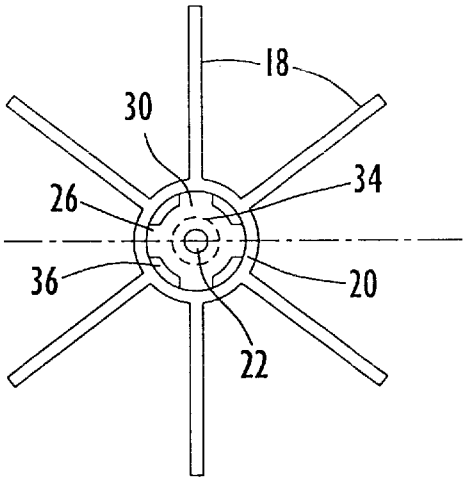
FIG. 2 is a cross sectional end view of the projectile.

For a fin-stabilized projectile, FIG. 2 illustrates splines 26 in the shaft 20 that ride slots or grooves 36 in the boom 30 that prevent rotation of the shaft 20 relative to the boom 30. For the purpose of illustration, four splines 26 and four slots or grooves 36 are shown, each subtending an angle of approximately 45 degrees.

Figure 3:
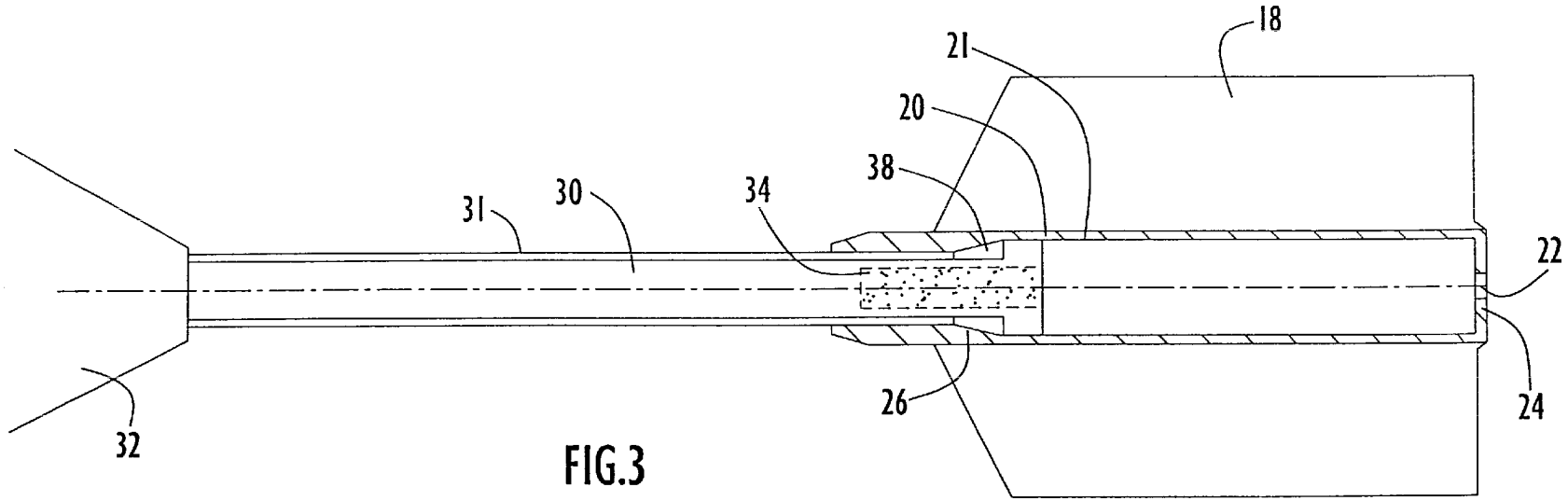
FIG. 3 is a partial longitudinal sectional view of the projectile in the flight condition.

For a fin-stabilized projectile, FIG. 3 illustrates the empennage 18 and slidable hollow shaft 20 and fixed boom 30 in its fully elongated form as it would appear shortly after exiting the launch tube. Upon full extension of the shaft 20, the splines 26 engage taper lock 38 in the boom 30, whereupon relative motion ceases between the shaft 20 and boom 30.

In some instances it may be preferred to augment or insure development of the high pressure of the gas in the cavity by such means as igniting a small piece of propellant within the cavity or by releasing a compressed gas cartridge approximately simultaneously with ignition of the propellant driving the projectile in the launch tube.

Figure 4B:
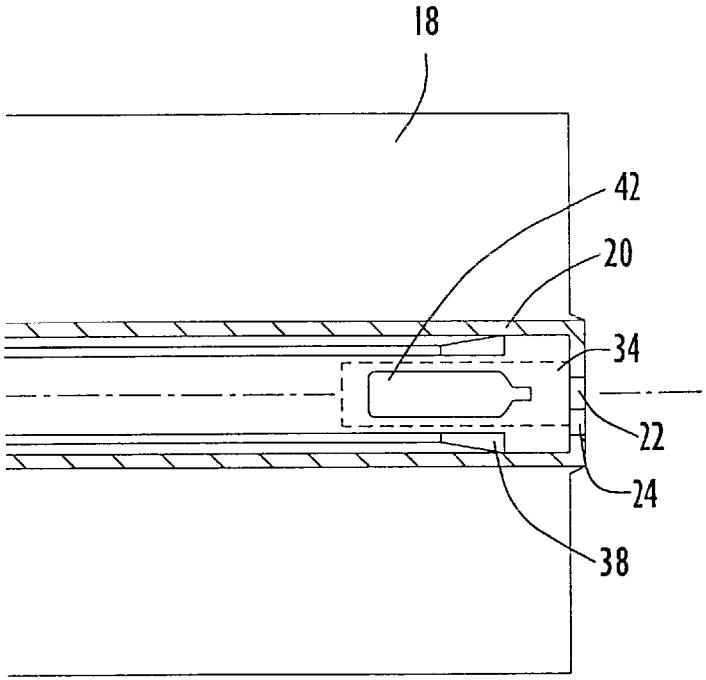
FIG. 4B is a partial longitudinal view of another embodiment of the projectile having a compressed gas cylinder assembled in the boom cavity.
Figure 4A:
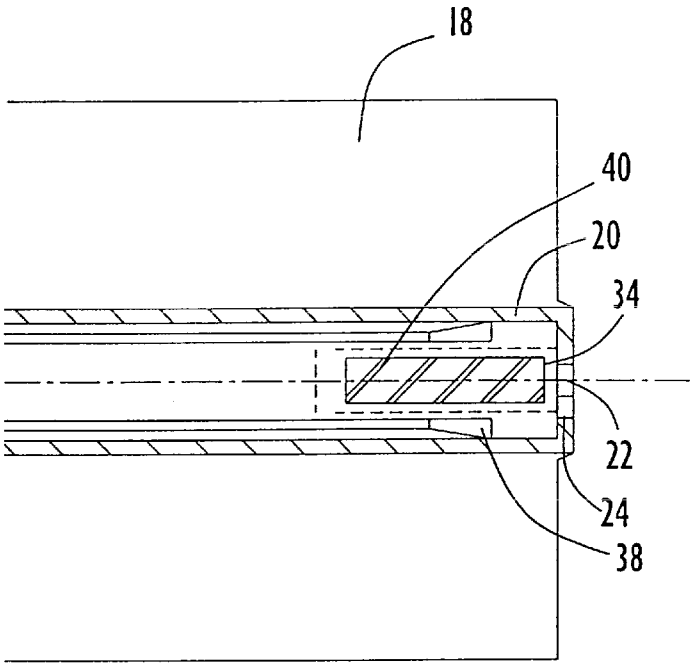
FIG. 4A is a partial longitudinal view of another embodiment of the projectile having a solid propellant assembled in the boom cavity.

FIG. 4A is a partial longitudinal view of the projectile having a piece of solid propellant 40 assembled in the boom cavity 34. FIG. 4B is a partial longitudinal view of the projectile having a compressed gas capsule or cylinder 42 assembled in the boom cavity 34.

Figure 5:
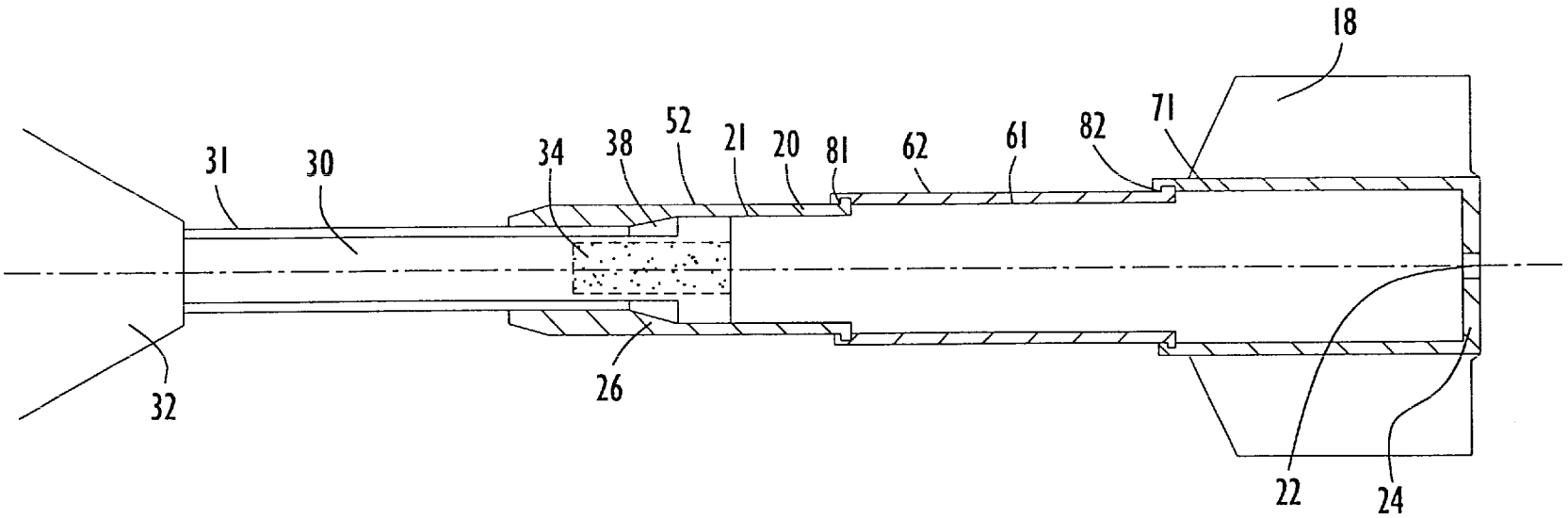
FIG. 5 is a partial longitudinal sectional view of the projectile in the flight condition having a hollow shaft comprised of telescoping-link sections.

For very long deployment distances of the shaft relative to the boom, the shaft can be comprised of unfolding telescoping links, like that of an antenna. For a fin-stabilized projectile, FIG. 5 illustrates the elongated projectile in its flight configuration when the hollow shaft is comprised of 3 telescoping sections. Here, as described in my prior patent, the locking surfaces 21 of the most forward section of the hollow shaft 20 and 31 of the boom may be the same as that for the single-section hollow shaft shown in FIG. 1. Moreover, "locking" of the three sections of the shaft onto each other during the projectile transit in the tube is effected in the same manner as for the single-section hollow shaft "locking" onto the boom. Thus, the three sections of the hollow shaft 20 are fully folded over one another and over the boom 30 during the projectile transit in the tube. In particular, referring to FIG. 5, the outer surface 52 of the most forward section is "locked" onto the inner surface 61 of the middle section; the outer surface 62 of the middle section is "locked" onto the inner surface 71 of the most aft section. For structural integrity and to arrest deployment, the joint connections 81 and 82 at each end of the middle section can be comprised of taper-lock jam devices, like that previously described between the hollow shaft and boom for the single-unit hollow shaft. The alternative method of "locking" the shaft and boom using the differential pressure between the exterior and interior surfaces of the shaft vertical end wall is also applicable to both single- or multi-unit shaft sections. Similarly, the mechanical "lock" release and the boom cavity gas forced deployment of the sectioned hollow shaft on exiting the tube is effected in the same manner as for the previously described single-unit hollow shaft. The acceleration-time deployment of the shaft sections can be controlled by providing for and adjusting the sliding friction between the component shaft sections and boom, by adjustment of the boom cavity volume and shaft orifice area opening, and by use of a ball check valve, reed-type valve, flapper valve, etc.

Spin-stabilized projectiles can be illustrated as in the above figures, except for the absence of fins. Here, only the hollow shaft is deployed and its geometry can be contoured to provide an extended "boattail".

Figure 6:
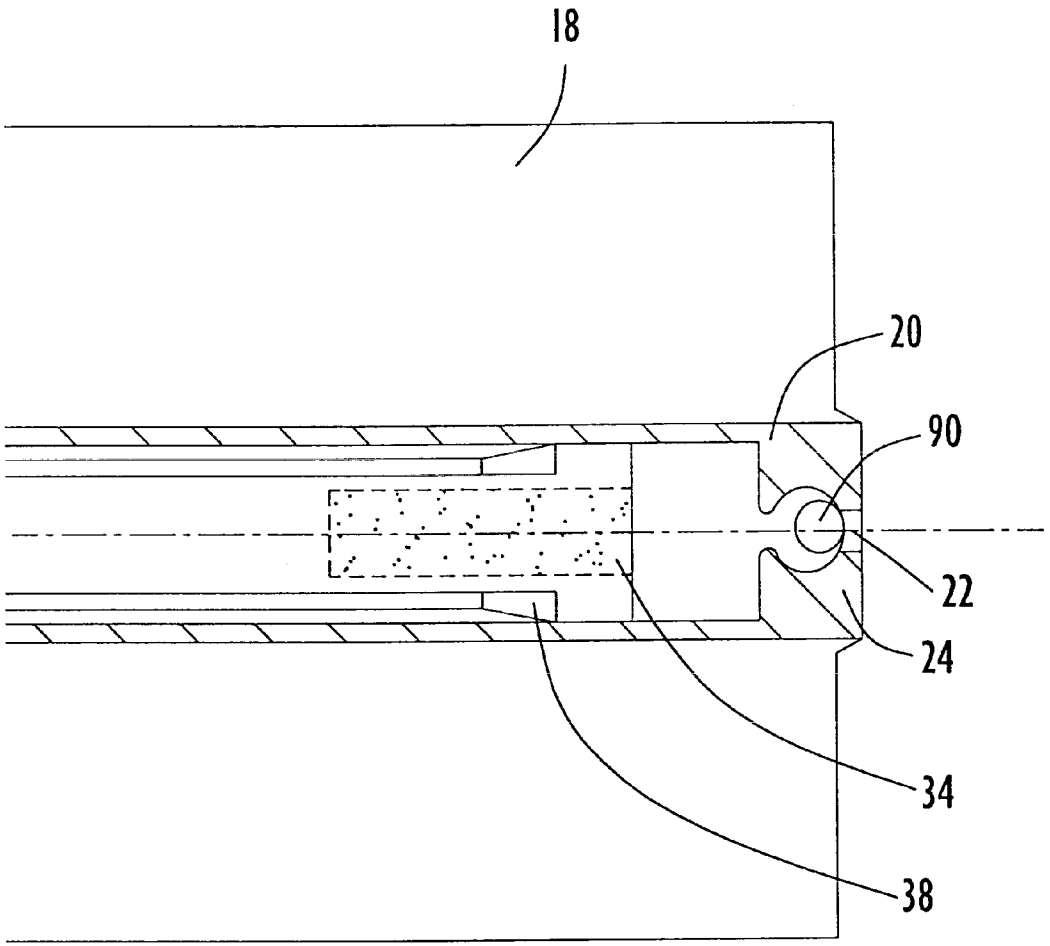
FIG. 6 is a partial longitudinal sectional view of the projectile showing a valve to limit or prevent the escape of entrapped cavity gas.

Furthermore, if it is desired to retain the entrapped cavity gas within the projectile and thereby hasten or insure projectile lengthening, a valve (e.g., ball check valve, reed-type valve, flapper valve, etc.) can be placed at the orifice and within the shaft to prevent or restrict escape of entrapped cavity gas when the cavity pressure exceeds the external ambient pressure. FIG. 6 is a partial longitudinal view of the projectile having a ball check valve 90, which can alternatively be a reed or flapper valve. Also, otherjam and lock devices to arrest and secure the deployed shaft may be preferred, such as a crushable impact and jam material in place of the illustrated taper lock.

In a typical application of this invention, the rearward movement of the projectile center-of-pressure obtained through the rearward movement of fins relative to the projectile center-of-gravity allows for projectile stability to be improved or maintained and for increased warhead weight with a reduced fin size. The reduced fin size provides reduced aerodynamic drag, increased velocity, increased effective range, and improved accuracy through reduced tip-off misalignment caused by muzzle blow-by with reverse flow at the tube exit.

For example, projectile fins are used to provide restoring moments necessary for stability and typically contribute 30 to 50 percent of the total projectile aerodynamic drag. The rearward extension of the fins increases the distance between the fin center-of pressure and the projectile center-of-gravity. Hence, compared to a projectile with a fixed fin configuration, the same fin restoring moment for a rearward slidable fin can be attained by a reduced fin size with reduced projectile aerodynamic drag, since the latter varies approximately with the fin total planform area. Drag reductions of 10 to 25 percent are conceivably attainable with the use of a slidable empennage.

Furthermore, a present constraint on warhead weights on fin-stabilized projectiles arises from the limited empennage restoring moment associated with the short distance between the fin center-of-pressure and the projectile center-of-gravity. A rearward slidable fin capability would allow for greatly increased restoring moments and increased warhead weight. Indeed, a slidable fin projectile could even provide stability for multiple, shaped-charge warheads arranged in tandem along the projectile axis.

Similarly, the rearward movement of the tail section and the accompanying projectile shape change allows for significant changes in the stability characteristics and reduction of aerodynamic drag of spin-stabilized projectiles. Also, the reduced projectile volume in the firing chamber attained by this invention for both fin- and spin-stabilized projectiles allows the additional space to be filled with propellant, resulting in increased muzzle velocity.

The tube pressure activated on and/or off contact between the deflected shaft and boom surfaces and/or projectile elongation can be used to perform a useful function, such as perform as a switch or complete an electrical circuit. As examples, such a pressure activated on and/or off contact can initiate or be part of a safety and arming or timing circuit or device, or initiate or be part of a battery or power supply circuit or device.

OPERATION OF THE INVENTION

As noted above, it is sometimes desirable to lengthen the flight configuration of the projectile over that of its in-tube transit configuration. As shown in FIG. 1, the projectile of this invention is a compact assembly when in the tube before launch. The mechanism disclosed herein automatically elongates the projectile upon completion of the launch sequence. When the main propellant charge is ignited in the tube, the combustion gases build up a very high pressure in the tube (not shown) to propel the projectile out. When this gas pressure builds up, the external pressure on the outer surface of the shaft 20 causes the shaft walls to deflect slightly. Since the clearance between the inner surface 21 of the shaft and the facing outer surface 31 of the boom is very small (typically on the order of 0.001 inch), the shaft deflection clamps the shaft to the boom surface, locking the shaft and boom in the position shown in FIG. 1.

The alternative method of "locking" of the shaft and boom during acceleration is attained utilizing the force derived from the differential pressure, created by propellant ignition in the launch tube, between the external and internal surfaces of the vertical end 24 wall of the shaft 20 shown in FIG. 1. This "locking" of the shaft and boom by means of differential pressure occurs when the ratio of shaft to boom-attached main body projectile accelerations within the tube is equal to or greater than one. This ratio may be expressed as:

$$a_S/a_p=(p_S/p_p)(A_S/A_p)(m_p/m_S)\geqq 1$$

where: "a" represents axial acceleration; "p" represents differential pressure; "A" represents area normal to the launch tube centerline; "m" represents mass; and the subscripts "S" and "P" represent the shaft and main body projectile, respectively. Within the launch tube (not shown), $p_S$ is approximately equal to $p_p$ and to the instantaneous launch tube pressure. $A_S$ does not include the area of the orifice opening 22 and any other open area not developing the differential pressure $p_S$. By appropriately selecting these parameters to achieve an axial acceleration ratio of greater than one, one can utilize the differential pressure across the shaft vertical end wall to achieve the desired "locking". Of course, this alternative method of "locking" the shaft onto the boom using the differential pressure between the external and internal surfaces of the shaft vertical end wall can be used by itself or in combination with the mechanical "locking" disclosed in my aforementioned patent to enhance the overall locking function.

Combining the two methods also allows flexibility in the design of the "locking" structures. Moreover, whereas there is some insignificant axial movement of the shaft relative to the boom prior to locking in the method described in my prior patent, no such movement occurs in the present alternative method. It is to be noted that the present alternative method does not require the clearance between the inner shaft and outer boom surfaces to be very small as required for my prior patented "locking" method which could present some difficulties in manufacturing. Indeed, the present alternative method has no moving parts in the shaft "locking" onto the boom, whereas my prior "locking" method requires deflection of the shaft onto the boom.

During the burn of the propellant, some of this high pressure gas enters into and is trapped in the cavity 34 of the boom 30. The cavity will remain pressurized until the projectile emerges from the launching tube into atmospheric pressure. On exiting the launching tube, the shaft experiences a reduction of ambient pressure causing the shaft to deflect away from the boom. In addition, the force acting on the shaft vertical end wall terminates. In this way the shaft is released from the boom, thereby permitting the shaft to slide on the boom to an extended position. The high pressure of the cavity gas relative to the reduced ambient pressure acting on the vertical end wall 24 of the shaft 20 causes the shaft 20 to be driven to the aft flight position shown in FIG. 3.

A small ball check valve, flapper, or reed-type valve can be provided to retain or restrict the entrapped gas in the cavity, if desired. To insure and/or augment activation of the sliding motion of the shaft, an internal source of energy can be provided. As shown in FIG. 4A, a small solid propellant charge 40 can be installed in the cavity of the boom and ignited during the projectile transit in the tube. The combustion gases from this propellant charge will extend the shaft on the boom in the manner described above. Similarly, as shown in FIG. 4B, a capsule or container 42 of compressed gas can be provided in the boom cavity and activated during the projectile transit in the tube to accomplish the projectile extension as described above.

The movement of the shaft at a precise time in the launch sequence makes it possible to use this shaft movement to activate a switch which could control a safety and arming circuit, initiate a battery or other power sources or control other functions associated with the launch procedure.

Thus, to provide the advantages of an elongated fin-stabilized or spin-stabilized projectile it can be seen that there is herein provided a tube launched projectile having a very compact configuration in the launch tube to maximize propellant space in the tube while, at the same time, having an automatic, simple, reliable mechanism for extending the projectile length after launch.

Having described preferred embodiments of a new and improved LOCK AND SLIDE MECHANISM FOR TUBE LAUNCHED PROJECTILES, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A tube launched stabilized projectile for launching a payload and having fore and aft portions along a longitudinal axis, said projectile having a mechanism to lengthen the projectile's flight configuration over that of its pre-launch configuration, a combustible propellant within the tube for launching said projectile from the launch tube by high pressure of combustion gases, said projectile comprising:

a body containing a payload at the fore end of said projectile, said body defining the longitudinal axis;

a boom having fore and aft ends and extending aft from said body along the longitudinal axis and having an internal cavity at its aft end;

a hollow shaft surrounding a portion of said boom and having fore and aft ends, a peripheral wall extending longitudinally and an aft end wall;

launch locking means for positively locking said hollow shaft with said boom so as to prevent relative motion between said hollow shaft and said boom during an initial portion of the launch of the projectile corresponding to at least part of the transit of said projectile in the tube;

release means for positionally releasing engagement of said hollow shaft with said boom so as to allow relative motion between said hollow shaft and said boom after exiting the tube and during flight of the projectile;

said launch locking means comprising force application means for applying a locking force to at least one of said walls during said initial portion of the launch to urge said one wall in a direction toward said boom;

flight locking means at the aft end of said boom for locking said hollow shaft in the flight configuration with the fore end of said hollow shaft more proximate the aft end of the boom; and means for changing the projectile from pre-launch to flight configuration when said projectile is propelled out of the tube.

2. The projectile of claim 1:

wherein said at least one wall is said peripheral shaft wall;

wherein said launch locking means comprises means for positively locking said peripheral shaft wall onto said boom during said initial portion of said launch; and wherein said launch locking means and said release means include spacing between said peripheral shaft wall and said boom over a pre-determined part of their lengths such that said peripheral shaft wall is slightly deflected and locked onto said boom over said pre-determined part of their lengths by the elevated ambient pressure in the tube and said peripheral shaft wall is deflected away from said boom by reduced ambient atmospheric pressure.

3. The projectile of claim 2, wherein the means for changing the projectile from a pre-launch configuration to a flight configuration includes:

a source of high pressure gas which causes said locking of said hollow shaft onto said boom and is supplied into said internal cavity of said boom, said gas being maintained at elevated pressure in said internal cavity until said projectile emerges from the tube, said launch locking means being released to allow said hollow shaft to slide along said boom; and the gases in said internal cavity expanding into the space between said boom and said peripheral shaft wall, a reaction force of said gas against the inside of the aft end wall of said hollow shaft causing said hollow shaft to slide along said boom and lengthen projectile to the flight configuration, and exit of the said internal cavity gas through said hollow shaft orifice to the ambient atmosphere.

4. The projectile of claim 3, wherein said flight locking means comprises:

a sloping ramp surface on the outer surface at the aft end of said boom; and a sloping ramp surface on the inner surface of said hollow shaft adjacent the fore end of said hollow shaft, said ramps being configured and positioned to cause the ramps to lock together when said hollow shaft slides to the flight configuration on said boom.

5. The projectile of claim 4, wherein the source of high pressure gas in said internal cavity is combustion gas from the burning of the propellant in the tube.

6. The projectile of claim 4, wherein the source of high pressure gas in said cavity is a solid propellant unit ignited in said cavity during the time the projectile is within said tube.

7. The projectile of claim 4, wherein the source of high pressure gas in said cavity is a compressed gas cylinder released in said cavity during the time the projectile is within said tube.

8. The projectile of claim 3, wherein said flight locking means comprises crushable impact and jam material to secure the fore end of said hollow shaft to the aft end of said boom.

9. The projectile of claim 2, wherein the spacing between said peripheral shaft wall and said boom is sized to accommodate elastic deflection of said peripheral shaft wall.

10. The projectile of claim 1:

wherein said at least one wall is said shaft aft end wall;

wherein said force application means derives said engagement force from a differential gas pressure created across opposite surfaces of said aft end wall of said hollow shaft by high pressure gas created by propellant ignition in the launch tube to force said aft end wall toward said boom.

11. The projectile of claim 10:

wherein said hollow shaft aft end wall has an orifice defined therethrough communicating with the interior of said hollow shaft; and wherein said means for changing the projectile from a pre-launch configuration to a flight configuration includes:

means conducting said high pressure gas into said internal cavity of said boom, said gas being maintained at elevated pressure in said internal cavity until said projectile emerges from the tube, said launch locking means being released to allow said hollow shaft to slide along said boom;

means allowing the gases in said internal cavity to expand into space between said boom and said aft end wall of said shaft causing said hollow shaft to slide along said boom and lengthen the projectile to the flight configuration; and means permitting egress of the said internal cavity gas through said orifice to the ambient atmosphere.

12. The projectile according to claim 10 wherein said force application means comprises means for establishing said engagement force according to the following criteria:

$$a_S/a_p=(p_S/p_p)(A_S/A_p)(m_p/m_S)\geqq 1$$

where: "a" represents axial acceleration; "p" represents differential pressure; "A" represents area normal to the launch tube centerline; "m" represents mass; and the subscripts "S" and "P" represent the shaft and main body projectile, respectively.

13. The projectile of claim 1, wherein said hollow shaft is comprised of extendable telescoping links.

14. The projectile of claim 13, wherein said shaft comprises at least two extendable telescoping links.

15. A method of launching a stabilized projectile from a launch tube, said projectile carrying a payload and having fore and aft portions along a longitudinal axis, said projectile further comprising a boom and slidably disposed in a hollow shaft, said method including lengthening the projectile flight configuration over that of its pre-launch configuration, wherein a combustible propellant is disposed within the launch tube for launching said projectile creating high pressure combustion gases, said method comprising the steps of:

(a) positively urging said hollow shaft toward said boom by means of said high pressure combustion gases so as to prevent relative motion between said hollow shaft and said boom during an initial portion of the launch of the projectile corresponding to at least part of the transit of said projectile in the tube;

(b) terminating said urging of step (a) so as to allow relative motion between said hollow shaft and said boom after exiting the tube and during flight of the projectile;

(c) changing the projectile from pre-launch to flight configuration when said projectile is propelled out of the tube; and (d) locking said hollow shaft in said flight configuration wherein the fore end of said hollow shaft is more proximate the aft end of the boom.

16. The method of claim 15 wherein step (a) comprises positively locking a peripheral shaft wall onto said boom during said initial portion of said launch by:

(a.1) providing a space between said peripheral shaft wall and said boom over a pre-determined part of their lengths; and (a.2) slightly deflecting said peripheral shaft wall into locked engagement with said boom over said pre-determined part of their lengths by means of elevated ambient gas pressure in the tube during said initial portion of said launch.

17. The method of claim 16 wherein step (b) comprises deflecting said peripheral shaft wall is deflected away from said boom by reducing said ambient gas pressure to substantially atmospheric pressure.

18. The method of claim 15 wherein step (a) comprises applying a differential gas pressure created across opposite surfaces of an aft end wall of said hollow shaft by means of said high pressure combustion gases created by propellant ignition in the launch tube to force said aft end wall toward said boom.

19. The method of claim 18 wherein step (a) includes the step of establishing said differential gas pressure according to the following criteria:

$$a_S/a_p=(p_S/p_p)(A_S/A_p)(m_p/m_S)\geqq 1$$

where: "a" represents axial acceleration; "p" represents differential pressure; "A" represents area normal to the launch tube centerline; "m" represents mass; and the subscripts "S" and "P" represent the shaft and main body projectile, respectively.

20. The method of claim 15 wherein step (c) comprises the steps of:

(c.1) providing said high pressure gas into an internal cavity of said boom, said gas being maintained at elevated pressure in said internal cavity until said projectile emerges from the tube;

(c.2) releasing locking of said hollow shaft to allow said hollow shaft to slide along said boom;

(c.3) allowing the gases in said internal cavity to expand into space between said boom and the aft end wall of said shaft to reduce the differential pressure across said aft end wall, causing said hollow shaft to slide along said boom and lengthen the projectile to the flight configuration; and (c.4) permitting egress of the said internal cavity gas to the ambient atmosphere.

21. A tube launched stabilized projectile for launching a payload and having fore and aft portions along a longitudinal axis, said projectile upon leaving the launch tube, the projectile's length is increased from that of its pre-launch configuration, and wherein a combustible propellant is disposed within the tube for initiating launching of said projectile from the launch tube by means of high pressure combustion gases, said projectile comprising:

a body containing a payload at the fore end of said projectile, said body defining the longitudinal axis;

a boom having fore and aft ends and extending aft from said body along the longitudinal axis;

a hollow shaft surrounding a portion of said boom and having fore and aft ends, a peripheral wall extending longitudinally and an aft end wall;

launch locking and release means for positionally locking said hollow shaft in engagement with said boom during launch to prevent relative motion between said hollow shaft and said boom during at least an initial portion of the launch of the projectile corresponding to at least part of the transit of said projectile in the tube, and for releasing engagement of said hollow shaft with said boom after exiting the tube and during flight of the projectile so as to allow relative motion between said hollow shaft and said boom, said launch locking and release means comprising:

force application means for utilizing said high pressure combustion gases during said initial portion of the launch to create a differential pressure across opposite surfaces of said aft end wall to apply a locking force to said aft end wall at a level sufficient to urge said aft end wall longitudinally toward said boom; and force removal means for reducing said force below said sufficient level upon said projectile exiting said tube to permit relative longitudinal movement of said shaft relative to said boom;

means for changing the projectile from pre-launch to flight configuration when said projectile is propelled out of the tube; and flight locking means at the aft end of said boom for locking said hollow shaft in the flight configuration with the fore end of said hollow shaft more proximate the aft end of the boom.

22. The projectile according to claim 21 wherein said force application means comprises means for said locking force at said sufficient level in accordance with the following relationship:

$$a_S/a_P=(p_S/p_P)(A_S/A_P)(m_P/m_S)\geqq 1$$

where: "a" represents axial acceleration; "p" represents differential pressure; "A" represents area normal to the launch tube centerline; "m" represents mass; and the subscripts "S" and "P" represent the shaft and main body projectile, respectively.

* * * * *